US005822279A

United States Patent [19]

Cuche et al.

[11] Patent Number: 5,822,279

[45] Date of Patent: Oct. 13, 1998

[54] WATCH CASE WITH A ROTARY RIM

[75] Inventors: Cyril Cuche, Bienne; Jacques Müller, Reconvilier, both of Switzerland

[73] Assignee: SMH Management Services AG, Biel, Switzerland

[21] Appl. No.: 930,594

[22] PCT Filed: Mar. 5, 1997

[86] PCT No.: PCT/CH97/00087

§ 371 Date: Oct. 8, 1997

§ 102(e) Date: Oct. 8, 1997

[87] PCT Pub. No.: WO97/33209

PCT Pub. Date: Sep. 12, 1997

[30] Foreign Application Priority Data

Mar. 5, 1996 [CH] Switzerland ..... 00571/96

[51] Int. Cl.[6] ..... G04B 37/00

[52] U.S. Cl. ..... 368/295

[58] Field of Search ..... 368/294–296

[56] References Cited

U.S. PATENT DOCUMENTS

| | | | |
|---|---|---|---|
| 4,815,053 | 3/1989 | Dal Busco | 368/294 |
| 4,975,893 | 12/1990 | Dal Busco | 368/294 |
| 5,122,997 | 6/1992 | Schneider et al. | 368/294 |
| 5,541,895 | 7/1996 | Nussbaum | 368/295 |
| 5,654,941 | 8/1997 | Joss | 368/295 |

FOREIGN PATENT DOCUMENTS

| | | |
|---|---|---|
| 536 509 | 4/1973 | Switzerland . |
| 631 592 G | 8/1982 | Switzerland . |
| 665 522 | 5/1988 | Switzerland . |
| 677 713 | 6/1991 | Switzerland . |

*Primary Examiner*—Vit W. Miska
*Attorney, Agent, or Firm*—Griffin, Butler, Whisenhunt & Szipl, LLP

[57] ABSTRACT

A watch having a rotating bezel associated with a system of axial ratchets and a ring allowing the rotating bezel (2) to be snap fitted onto the middle part (4) and assuring the functions of centring, holding and angular positioning said bezel. The ring (8) has a substantially U-shaped cross section, a lower side of which is fixed to a middle part by being driven onto said middle part and the other side of which has a prominent surface (20) onto which the bezel (2) is mounted. The ratchets are formed by flexible strips (26) cut into the flat base (18) of the ring (8). The system may be simply and inexpensively manufactured and mounted.

6 Claims, 2 Drawing Sheets

WATCH CASE WITH A ROTARY RIM

The present invention relates to a watch case including a rotating bezel snap fitted onto a ring attached to a middle part of the case, and positioning means for maintaining the bezel in predetermined angular positions, the ring having in cross section a base which extends substantially in a radial plane, perpendicular to a central axis of the case, and an external edge having an external profile onto which the bezel is snap fitted so as to be centred and held in a parallel direction to said axis, the positioning means including a toothing arranged on the lower face of the bezel and at least one ratchet arranged to engage in the toothing, said ratchet being formed by a strip which is flexible in the direction of said axis.

A watch case fitted with a rotating bezel supported by the middle part by means of a system of rings is known. For example according to CH Patent No 677 713, the bezel is held onto the middle part by a metal ring of L shaped cross section having a truncated external surface onto which the bezel is snap fitted. This ring includes an annular recess intended to accommodate a ring shaped spring. Ratchets are cut into the ring shaped spring and act in an axial direction on the lower toothing of the bezel. This toothing is formed by cuts passing through a lower portion of the bezel. This system, while assuring the centring and positioning of the bezel, has disadvantages mainly as regards assembly, since it includes various parts, namely a metal ring holding another ring for mounting the crystal and itself carrying on the base thereof said ratchet ring shaped spring.

CH Patent No 631 592 discloses a system for fixing a rotating bezel which includes on its lower face a rim which is held by being snap fitted onto a middle part including a similar annular rim. Said system also includes a strip-spring fixed to the middle part. The strip-spring carries ratchets which exert axial pressure on the toothing of the bezel, so that the two aforementioned rims abut against each other along a tangential cone and assure, via friction, the locking of the bezel in rest position. This system is, however, not simple to make since it requires accurate machining of the rims on the middle part and the bezel. Moreover, mounting of the bezel is delicate, because of the high level of rigidity of the rim of the middle part.

There is also known from CH Patent No 665 522 a system for holding a bezel on a middle part by means of a single part provided with ratchets acting in a radial direction on a lower surface of said bezel. In contrast to the two preceding Patents wherein the action of the ratchets is axial, this radial action does not allow pressure to be obtained on the bezel contributing to the positioning and jamming of said bezel.

An object of the present invention is to provide a system provided with axial ratchets and allowing a rotating bezel to be snap fitted onto a middle part. The desired object is to achieve relatively simple and inexpensive manufacturing and mounting of said system. Said system provided with ratchets must, in particular, assure all the functions of centring, holding and angular positioning of said bezel.

The invention thus concerns a watch case of the type defined hereinbefore, characterised in that the flexible strip is integral with the ring, the strip being cut into the base of said ring.

The present invention therefore allows all the previously cited functions to be achieved with a single ring, into the base of which each flexible strip acting as ratchet may easily be cut.

The manufacture of this ring is relatively simple, it is for example easy to manufacture it entirely by stamping. It is also inexpensive to mount and enables in particular significant savings of materials and time because the industrial production thereof is simple. The mounting of the ring onto the middle part of the watch has the same advantages of simplicity and cost since the ring may, for example, be directly driven onto the middle part.

Other features and advantages of this invention will appear more clearly in the following description of a preferred embodiment of a watch case having a rotating bezel according to the invention, with reference to the annexed drawings, in which.

Figure 1:
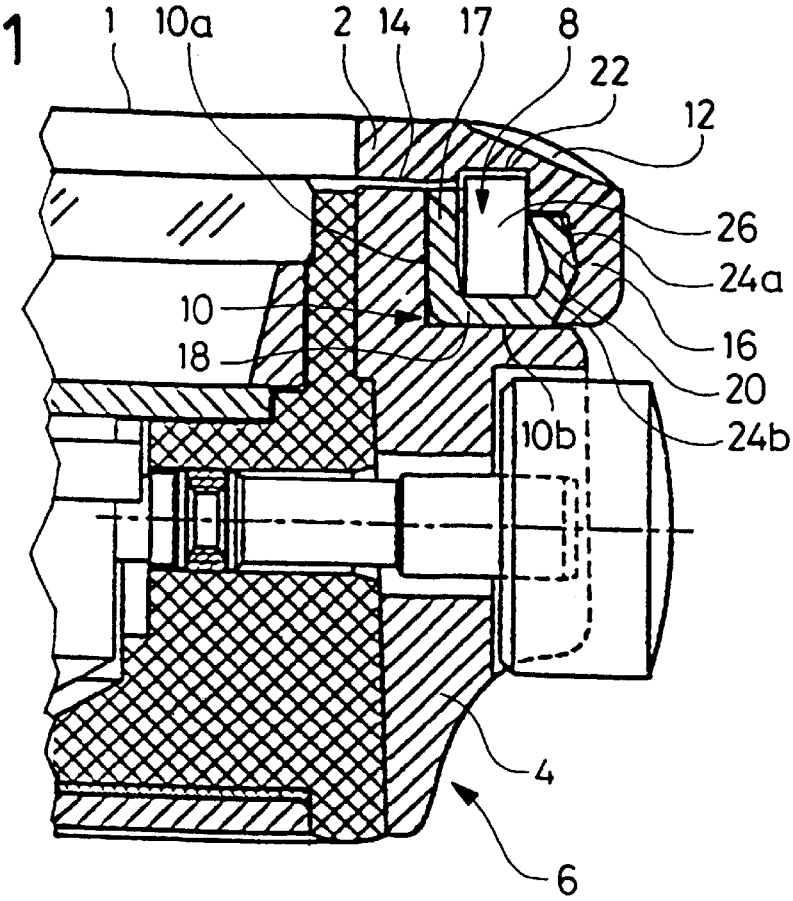
FIG. 1 shows a partial axial cross-section of a watch having a rotating bezel according to the present invention.
Figure 2:
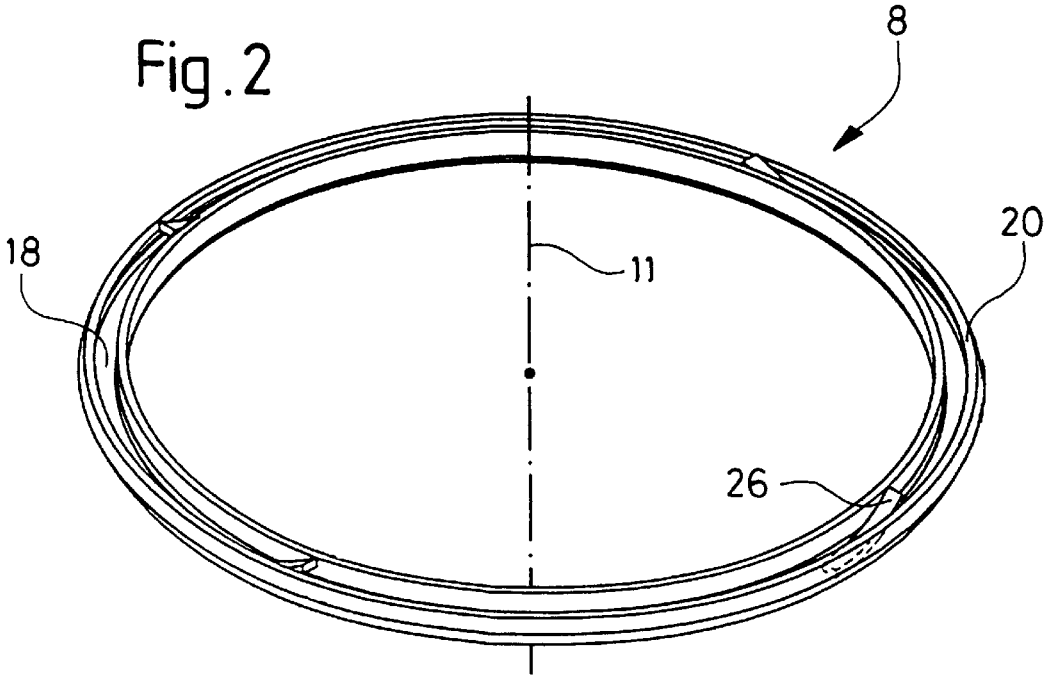
FIG. 2 is a perspective view of the whole of the ring supporting the rotating bezel.
Figure 3:
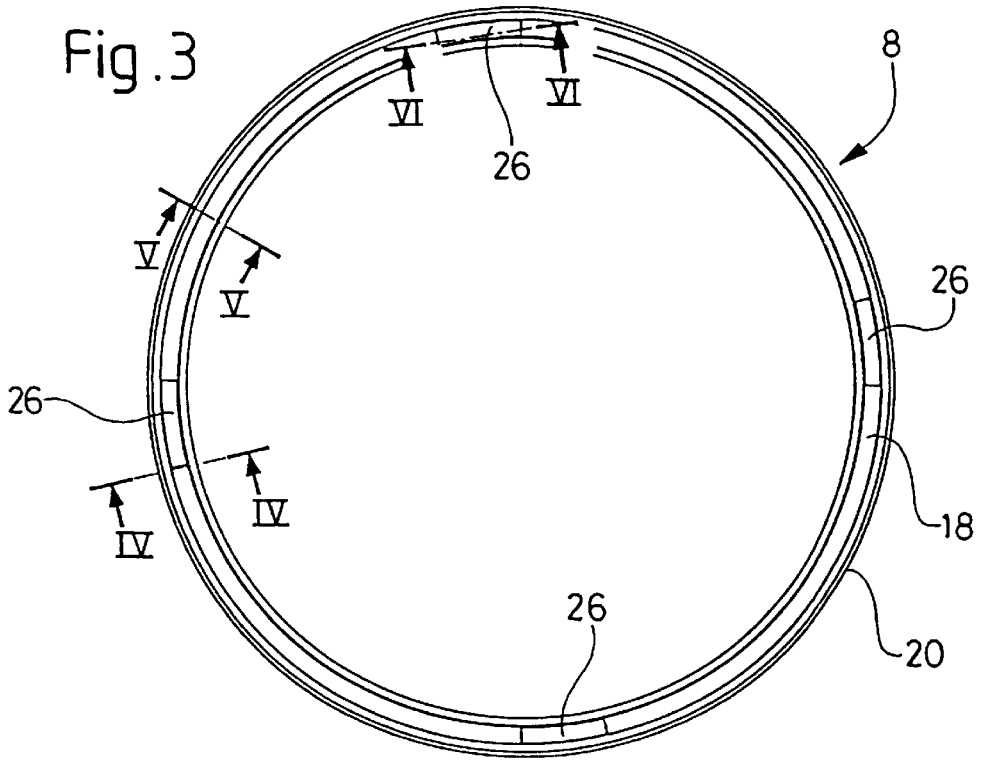
FIG. 3 shows the same ring seen from above.

FIG. 1 shows a watch case 6 including, on its upper face 1, a rotating bezel 2 mounted on a middle part 4 of case 6 with the aid of a ring 8 fixed onto said middle part 4. Middle part 4 has in its upper portion a substantially L-shaped shoulder 10, having a substantially cylindrical and vertical surface 10*a* and a substantially flat and horizontal surface 10*b*. Bezel 2 is able to rotate about a central axis 11 perpendicular to upper face 1 of case 6. It is made in a single piece including an upper portion, having an upper face 12 and a lower face 14, and a lateral portion 16 descending towards middle part 4.

In the preferred embodiment, ring 8 has a generally U-shaped cross section of approximately uniform thickness, this section including a vertical lateral portion 17 (FIGS. 4 and 5) situated inside and tightly applied against vertical surface 10*a* of the middle part, a horizontal base 18 applied against horizontal surface 10*b* of the middle part, and an external lateral portion in the shape of a convex edge whose external profile 20 is characterised by two truncated surfaces having opposite slants 20*a* and 20*b* (FIG. 5), thus forming a projection directed outwardly.

Shoulder 10 of middle part 4 is intended to accommodate ring 8, the vertical surfaces of the middle part and the ring allowing ring 8 to be mounted by directly driving the latter onto the middle part. This method of fixing is very rapid and enables the use of catches or other elements for preventing rotation of the ring and ratchets to be avoided.

Bezel 2 includes on its upper face 12 inscriptions relating to its function and on its lower face a toothing 22, including for example sixty teeth distributed along the circumference of the bezel. Lateral portion 16 of the bezel has on its internal face two truncated surfaces 24*a* and 24*b* having opposite slants, facing truncated surfaces 20*a* and 20*b* of the ring.

Flexible strips 26, acting as ratchets, are cut through flat base 18 of ring 8 and are raised axially, i.e. in the direction of central axis 11, towards toothing 22 of the bezel, so that their free ends engage via elasticity to assure the angular positioning of bezel 2.

The axial pressure exerted by flexible strips 26 on toothing 22 when the bezel is in its rest position has the effect of applying lower truncated surface 24*b* of its internal face against lower truncated surface 20*b* of external profile 20 of the ring.

In this rest position, bezel 2 is held radially and axially in a centred position on middle part 4 of watch case 6, and further, the low conicity of surfaces 20*b* and 24*b* assures a slight jamming which prevents any inadvertent rotation of the bezel. There exists a play between upper truncated surfaces 20*a* and 24*a*. The wearer of the watch may position rotating bezel 2 simply by exerting axial pressure downwards before rotating it.

FIGS. 2 to 6 show ring 8 as previously described, with, in this embodiment, four flexible strips 26 used as ratchets, these strips being preferably diametrically opposite in pairs in order to act simultaneously on the bezel. The free end of flexible strips 26 is straight and engages via elasticity in toothing 22 of bezel 2, which may thus only be rotated in a single direction. The direction of rotation is determined by the direction in which flexible strips 26 and toothing 22 of the bezel are made. Nonetheless, a bi-directional rotation may be obtained if the free end of flexible strips 26 is bent towards base 18 of ring 8, as illustrated in CH Patent No 631 592.

Figure 4:
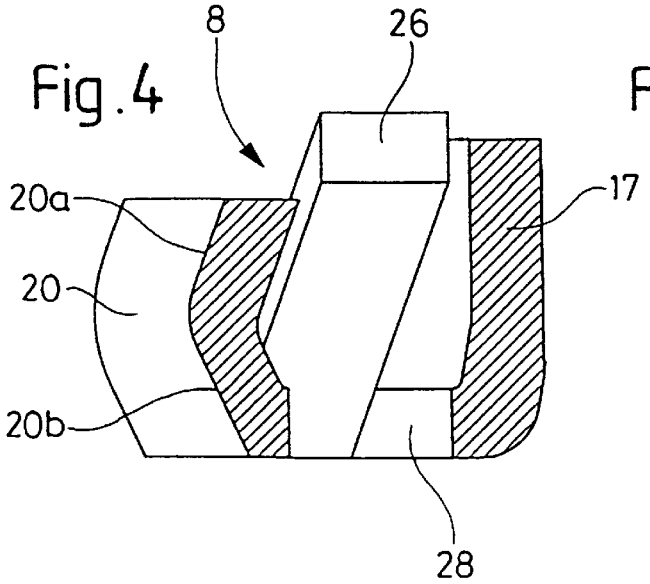
FIG. 4 is a cross-section along the line IV–IV of FIG. 3.
Figure 5:
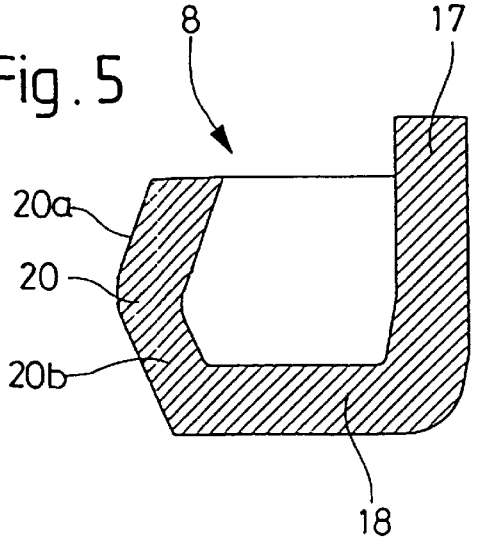
FIG. 5 is a cross-section along the line V–V of FIG. 3.

FIGS. 4 and 5 show cross-sections of ring 8 showing external profile 20 characterised by the two truncated surfaces having opposite slants 20*a* and 20*b*. Thus, rotating bezel 2 may easily be snap fitted above this ring due to the elasticity of the ring and/or the bezel. FIG. 4 also shows one of flexible strips 26 and the opening 28 made in base 18 of the ring by cutting the strip.

Figure 6:
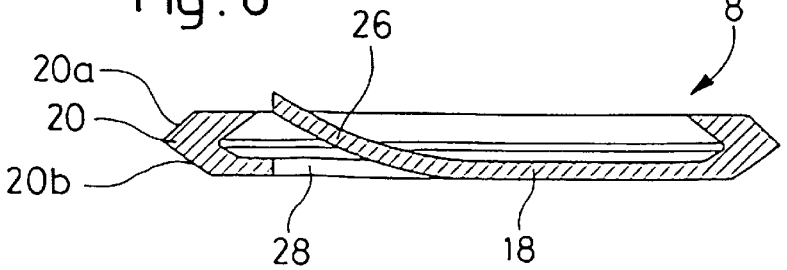
FIG. 6 is a cross-section along the line VI–VI of FIG. 3.

FIG. 6 is a tangential cross-section showing in more detail the longitudinal profile of one of flexible strips 26.

Ring 8 and rotating bezel 2 may be made of metal, but also of synthetic material. Moreover, the bezel and the middle part may be made in one or more parts. The bezel may or may not be detachable.

The description of the preferred embodiment in the example hereinbefore shows that the present invention enables relatively simple and inexpensive manufacturing and mounting to be obtained. The ring is a relatively simple part to produce industrially, likewise the mounting thereof onto the middle part may easily be achieved by driving said ring onto said middle part. However, the ring may be fixed onto the middle part by any other means, for example by bonding or welding. There may be any number of flexible strips 26, but preferably a number at least equal to two for reasons of symmetry of the forces exerted on the bezel.

What is claimed is:

1. A watch case including a middle part, a rotating bezel snap fitted onto a ring attached to said middle part, and positioning means for maintaining said bezel in predetermined angular positions, said ring having in transverse section a base which extends substantially in a radial plane, perpendicular to a central axis of said case, and an external edge having an external profile onto which said bezel is snap fitted so as to be centered and held in a parallel direction to said axis, said positioning means including a toothing arranged on a lower face of said bezel and at least one ratchet arranged to engage in said toothing, said ratchet being formed by a strip which is flexible in the direction of said axis, wherein said flexible strip is made in a single piece with said ring, said strip being cut into said base of said ring.

2. A watch case according to claim 1, wherein said ring has a U-shaped transverse profile, having a vertical lateral portion which is applied against said middle part.

3. A watch case according to claim 1, wherein said ring is driven onto said middle part.

4. A watch case according to claim 1, wherein said external profile of said ring includes a lower frustoconical surface onto which abuts a corresponding internal surface of said bezel to assure the holding and centering of said bezel.

5. A watch case according to claim 4, wherein said lower frustoconical surface of said ring is surmounted by an upper frustoconical surface having an opposite slant relative to said lower frustoconical surface to facilitate mounting of said bezel.

6. A watch case according to claim 1, wherein said base of said ring includes at least one pair of diametrically opposite flexible strips.

* * * * *